United States Patent [19]

Franek et al.

[11] 4,007,621

[45] Feb. 15, 1977

[54] CONTAINERS

[75] Inventors: Jozef Tadeusz Franek, Chorelywood; Paul Porucznik, St. Albans, both of England

[73] Assignee: The Metal Box Limited, Reading, England

[22] Filed: May 6, 1975

[21] Appl. No.: 574,966

[52] U.S. Cl. ..... 72/351; 72/345; 72/347

[51] Int. Cl.[2] ..... B21D 22/08; B21D 24/08

[58] Field of Search ..... 72/345, 347, 348, 351, 72/406; 113/1 G

[56] References Cited

UNITED STATES PATENTS

| | | | |
|---|---|---|---|
| 493,525 | 3/1893 | Schaake | 72/345 |
| 3,635,069 | 1/1972 | Eickenhorst | 72/345 |
| 3,817,076 | 6/1974 | Wallace | 72/351 |
| 3,822,576 | 7/1974 | Hardt | 72/348 |

*Primary Examiner*—Lowell A. Larson

*Attorney, Agent, or Firm*—Diller, Brown, Ramik & Wight

[57] ABSTRACT

This disclosure relates to processes for forming hollow articles by drawing; apparatus to carry out such processes; tool sets for incorporation in such apparatus; and hollow metal articles such as cans made by said methods.

18 Claims, 11 Drawing Figures

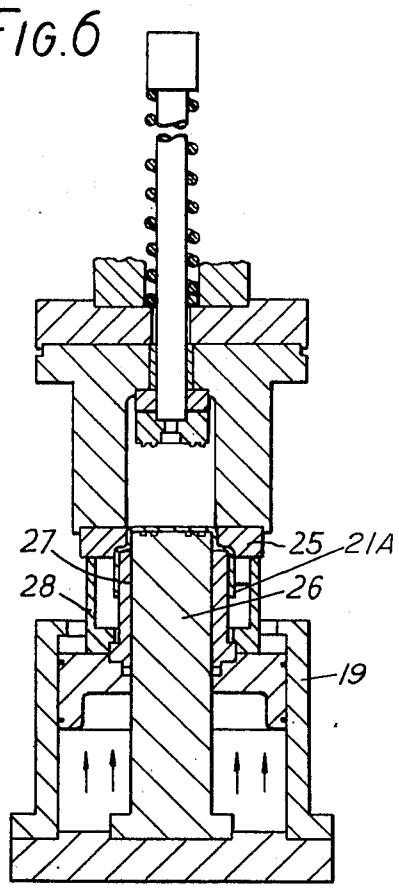
FIG. 4
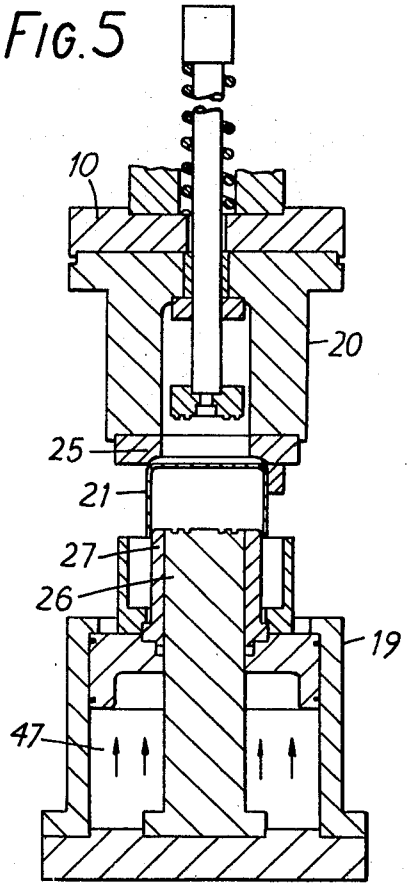
FIG. 5
FIG. 6

CONTAINERS

This invention relates to processes for forming hollow articles by drawing; apparatus to carry out such processes; tool sets for incorporation in such apparatus; and hollow metal articles such as cans made by said methods.

In a first aspect, the invention provides a method of making a hollow article by drawing, such process comprising a working cycle defined by a forward stroke and a return stroke in which a draw punch or mandrel and die means co-operating therewith are subjected to mutual approaching and withdrawing relative movement between them in the forward and return strokes respectively, wherein the relative velocity of such movement is positively controlled throughout the cycle to predetermined values according to the stage of the cycle.

Preferably, blank-holder means is provided to support a workpiece to be formed into a said article, said blank-holder means being continuously controlled to restrain the workpiece throughout at least part of the cycle.

In a preferred embodiment of the method, in which a first one of the draw elements comprising said punch or mandrel and said die means is brought from a remote first position towards a said workpiece placed in its path, said first element is stopped or nearly stopped at a point in said relative approaching movement at which the workpiece first becomes clamped between said draw elements, so that the subsequent operation of drawing the workpiece between said elements is commenced when the relative velocity is substantially zero.

Preferably the said relative velocity over a major part of said drawing operation is substantially constant.

Preferably also, said relative velocity is reduced to zero or nearly to zero at a stage in the return stroke when the said draw elements are in substantially the same relative positions as they are in at said point during the relative approaching movement in the forward stroke, for the purposes of stripping the workpiece from the tools.

According to a second aspect of the invention a draw press is provided for carrying out the method of the invention, the press being adapted so that in operation the said relative approach speed is continuously controlled.

According to a third aspect of the invention a draw press for performing a press process according to the invention has a frame including a base plate and opposed end walls upstanding therefrom to form substantially a 'U' shape. One said wall carries fixed cam means which are hollow and have profiled camming surfaces for co-operating with cam follower means associated with at least one of said draw elements to effect reciprocating movement thereof defining said forward and return strokes.

Preferably a shaft is supported by both end walls of the frame and extends through the cam means, and carries a turret and a bolster fixed to the shaft so that the whole assembly of shaft, turret and bolster can rotate within the cams, supported by the frame end walls. The turret carries a plurality of rams, each carrying a said first draw element and each having a said follower so that as the shaft rotates the followers are pushed first towards and then away from the corresponding bolster, a second one of said draw elements being carried by the bolster for co-operating with each of said first draw elements.

Preferably conduits for pressurised fluid are provided through the shaft so that pressurised fluid can be delivered from a stationary source to the rotating bolster and turret assembly, including preferably to the rams. This pressurised fluid can be used for blank-holding and/or for secondary forming operations.

Thermal control of the apparatus may be provided by means of fluid-conducting conduit means arranged to deliver fluid, at controlled temperature, into rotating parts of the press whence it may be conducted to the draw elements and any other parts requiring controlled temperature.

In a fourth aspect of the invention, a tool set including said punch and die is provided with means to maintain blank-holder control through the press stroke and positively prevent nipping of the cup rim. Preferably such a tool set is used in a press according to the invention, but it could also be used to advantage in some known types of press.

According to the invention in a fifth aspect, there is provided a redrawing tool having a punch and die with blank-holder, said punch being adapted to be surrounded by a fluid cushion, said cushion supporting a blank-holder and a blank-holder stop, said blank-holder stop coacting with a portion of the die to limit longitudinal blank-holder motion relative to the die whereby to prevent excessive blank-holder pressure on the workpiece.

Various embodiments of the invention will now be described, by way of example and with reference to the following drawings, of which:

FIGS. 4 to 7 show how the cup is fed to the tools and redrawn;

Figure 2A:
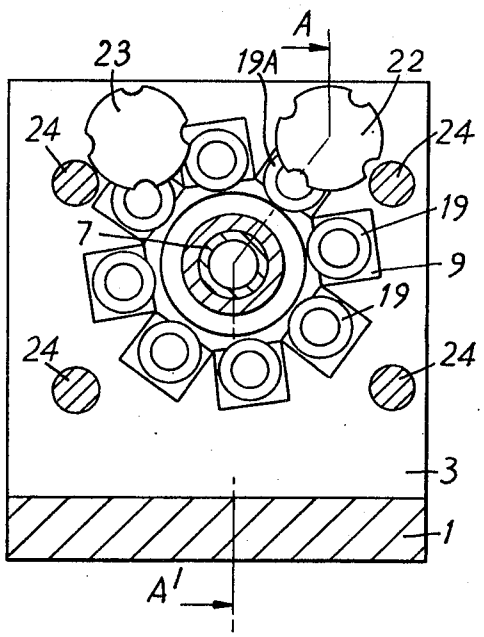
FIG. 2A is an end elevation, of the apparatus of FIG. 1, sectioned at the tools.
Figure 1:
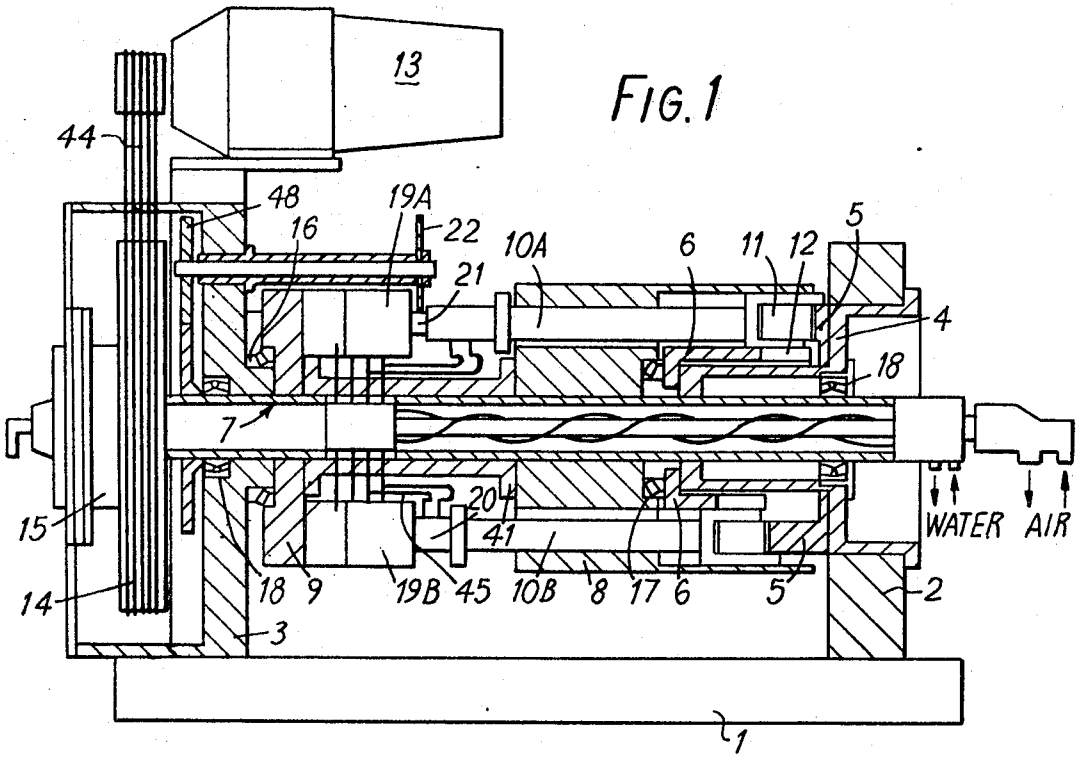
FIG. 1 is a side elevation, of apparatus according to the invention, sectioned on line A—A' in FIG. 2A.

Referring to FIGS. 1 and 2A the press shown therein has a press frame having a base plate 1, a first end wall 2 and a second end wall 3. The frame is preferably preloaded by longitudinal tie bars 24 (FIG. 2A) of the frame, which connect the end walls 2 and 3.

The frame end wall 2 carries a cam holder 4 to which a forward or push cam 5 and a return cam 6 are fixed. The cams 5, 6 are hollow and substantially cylindrical, having camming surfaces profiled to engage followers 11, 12 respectively so that the followers are at appropriate times (as will be evident hereinafter) caused by the cams to reciprocate parallel to the common axis of the cams.

A central shaft 7 is rotatably supported, coaxially with the cams 5, 6, by bearings 18 carried by the end wall 3 and cam holder 4, being rotatable therein about the said axis.

The shaft 7 carries coaxially a turret 8, a tool bolster 9 and a spacer 41 separating the turret 8 from the bolster 9. The turret 8, tool bolster 9 and spacer 41 are fixed to the shaft 7.

The turret 8 carries a plurality of equally spaced rams 10, two of which are indicated in FIG. 1 at 10A and 10B respectively, the rams 10 being arranged for reciprocation in the turret 8 parallel to the axis of shaft 7. Each forward cam follower 11 is carried by a respective one of the rams 10 and engages the push cam 5. Each return cam follower 12 is also carried by a respective one of the rams 10 to engage the return cam 6.

The forward thrust derived from cam 5 on the forward stroke of the ram is borne by a substantially forward thrust race 16 lying between the tool bolster or rest 9 and the frame wall 3. Axial preloading forces are borne by a thrust race 17 between the turret 8 and the cam holder 4.

The press is driven by a motor 13 fixed to the frame and driving, through belts 44, a pulley 14 and clutch 15 which are mounted on the shaft 7 outside the frame end wall 3.

The end of the shaft 7 remote from the clutch 15 is provided with two unions to enable air and water to be introduced into rotating parts of the press. The air is used to provide blank-holder pressure in lower tool units 19, two of which are indicated at 19A, 19B in FIG. 1, the tool units 19 being carried by the tool bolster 9. Water is used as a coolant for the tool units 19 on the bolster and for upper tool units 20, carried by respective rams 10. Air and water connections from the shaft 7 to the tool units 19 and 20 are indicated at 45 in FIG. 1.

FIG. 1 shows the arrangement of lower tool units 19, on the tool bolster 9, around the shaft 7: tool unit 19A is shown in FIG. 1 with a workpiece 21 in the feeding position to which it has been carried by a feed star wheel 22. Upon rotation of the shaft 7, the tool bolster 9 and turret 8 are carried round together, whilst the tool units 19 co-operate with the tool units 20 to perform a redrawing operation on each workpiece 21 held in a respective tool unit 19. When each tool unit 19 reaches an exit star wheel 23 (FIG. 2A), the latter removes the workpiece 21 which is now in the form of a redrawn can body (not shown). Rotation of the star wheels 22, 23 is co-ordinated with that of shaft 7 by gear means shown generally as 48, in FIG. 1.

While a press described with reference to FIGS. 1 and 2A may be used for drawing sheet material, it is particularly suitable for redrawing cup-shaped workpieces, for example formed by drawing sheet metal into a cup-shaped preform in another draw pass, which may be of the construction first described.

Figure 2B:
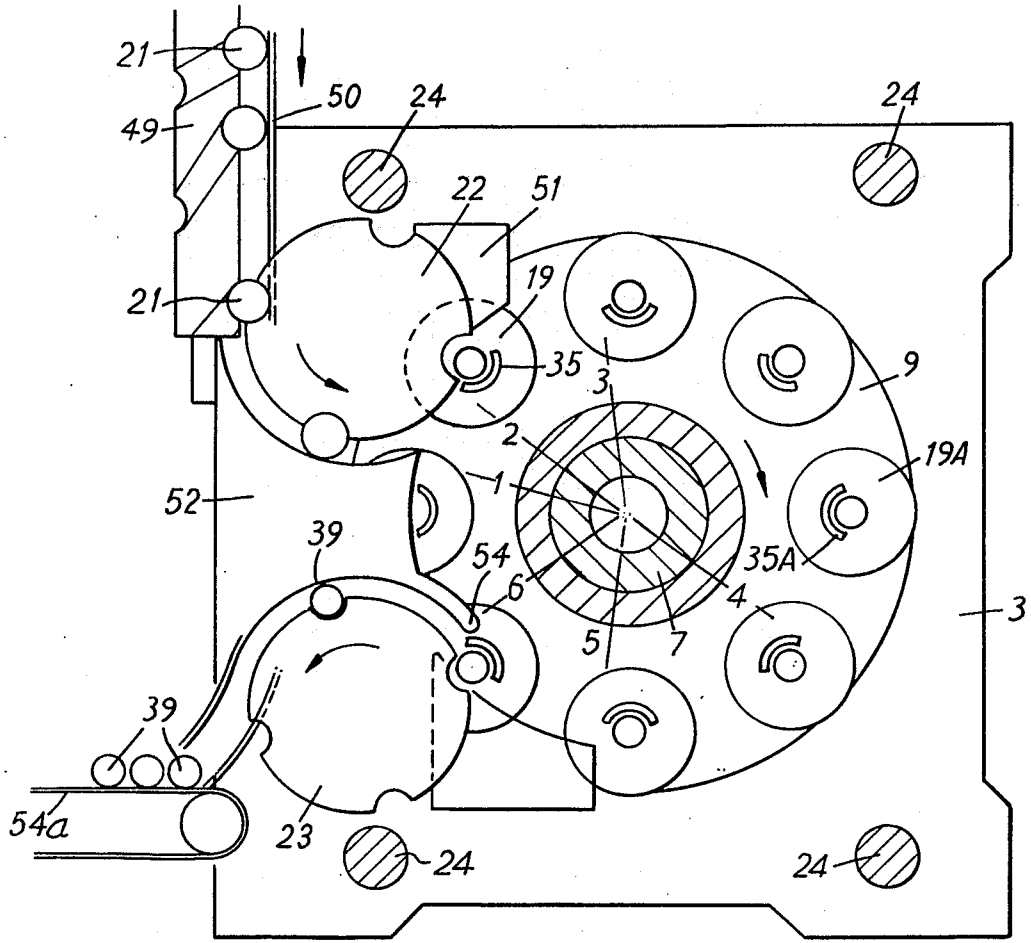
FIG. 2B is a similar view to FIG. 2A of an alternative arrangement of the apparatus.

FIG. 2B shows diagrammatically how a lead screw 49 working in conjunction with a rail 50 is used to space out cups 21 in readiness for each one to enter a recess in the star wheel 22. In conjunction with inner guide 52, and outer guide 51 the star wheel 22 moves each cup 21, by rotation to a tool 19 on the rotating tool bolster 9 where a cup locator 35 catches it. A second tool 19A is shown with its can locator 35 to show, in a general way, how the tool bolster 9 carries the tools round to the exit star wheel 23. During the rotation of the bolster round the central shaft 7 the cups 21 are redrawn into cans 39. On arrival at the protruding portion 54 of the inner guide 52 the star wheel 23 moves each can 39 away from the press on to a conveyor 54*a*. It will be seen that radial lines are marked 1, 2, 3, 4, 5 and 6 and these identify the approximate radial positions of the tools of FIGS. 4, 5, 6, 7, 8 and 9 respectively. The significance of each of these figures will become apparent but first the tool details will be explained by reference to FIG. 3.

Figure 3:
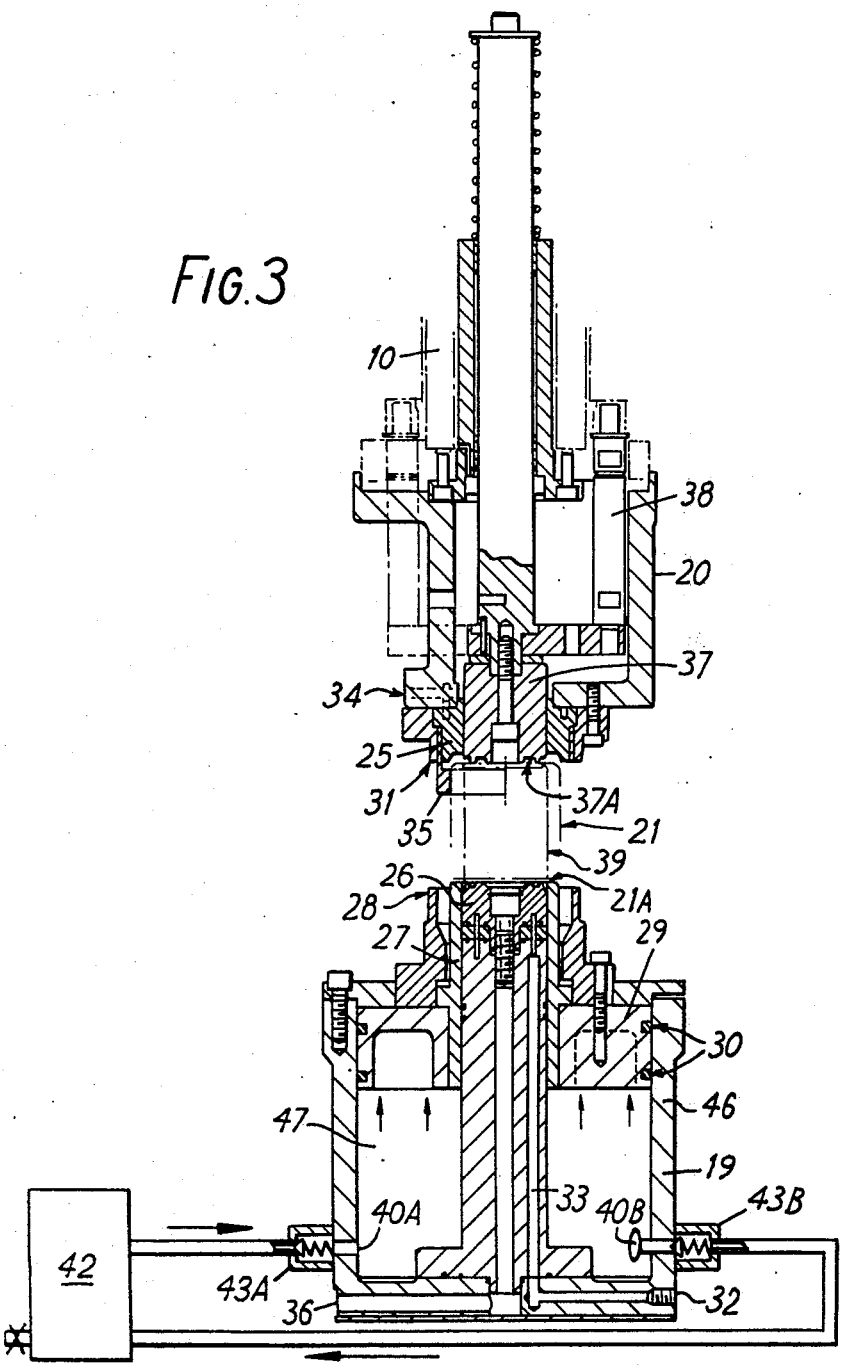
FIG. 3 is a sectioned side elevation of press tools for redrawing a cup, according to the method of the invention.

In FIG. 3, the tool set shown comprises an upper tool unit 20 and a lower tool unit 19. The upper tool 20 is carried by the ram 10 and includes a die 25, an ejector 37 within the die 25, and a limit ring 31 encircling the die 25, dependant from which is a cup stop 35.

The lower tool unit 19 includes a fixed punch or mandrel 26, a blank-holder 27 surrounding punch 26, a blank-holder stop 28 surrounding the blank holder 27, and a piston 29 secured to the stop 28. The piston 29 has piston rings 30 and is slidable within the housing 46. The housing 46 defining a chamber 47 in which the piston 29 is mounted for reciprocation. The punch 26, blank-holder 27 and stop 28 protrude out of the free end of the housing 46, at the beginning of the stroke. The blank holder 27, stop 28 and piston 29 are, however, movable coaxially along the punch 26 away from this position, as will be seen hereinafter.

Compressed air in the chamber 47 exerts a preferably substantially constant pressure on the rear face of piston 29 to control the axial movement of the blank-holder 27 and stop 28 relative to the punch 26. The air is introduced through a non-return valve 43A and inlet port 40A, from a receiver 42. An air vent 36, in the base of tool 19 leads to the hollow punch 26, to allow removal of the can 39.

Thermal control of the tool set is achieved by means of passages (not shown) for conducting fluid to the punch 26 through an entry port 32 into a longitudinal passage 33 in the punch. Fluid supply for the die 25 is introduced through a port 34 to the die 25 from the appropriate conduit 45 in FIG. 1.

Figure 7:
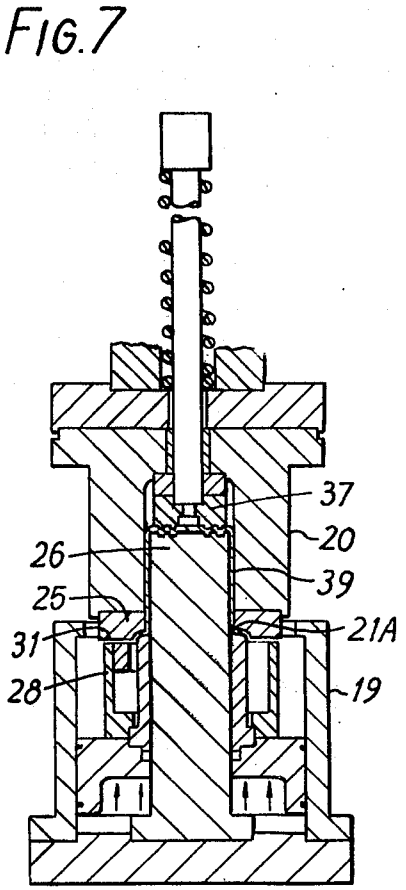

FIGS. 4 to 9 show simplified diagrams of the tooling of FIG. 3 to illustrate the method of the invention. Referring to FIGS. 3 and 4, a cup-shaped workpiece 21 is first positioned by the star wheel 22 in the tools against a locating ring 35 which is carried by the die 25. The ram 10 then brings the cup 21 towards the punch 26 and blank-holder 27 which it then encircles gentle in readiness to start the redrawing operation against the die 25 carried by the ram 10. During the drawing operation, best seen in FIG. 6 constant air pressure in the tool 19 controls the position of blank-holder 27 such that the blank holder stop 28 floats longitudinally with respect to the limit ring 31 (FIG. 3). Towards the end of the forward stroke of the ram, defining the drawing operation, when the blank-holder load per unit area will be increasing as the cup rim 21A is redrawn, the blank-holder stop 28, engages with the limit ring 31, to prevent the rim 21A being snatched or damaged by the die 25 and blank holder 27 as shown in FIGS. 6 and 7.

The minimum gap maintained, between blank-holder 27 and die 25, by the blank-holder stop 28 and the limit ring 31 is related to the material thickness of the cup 21, and will usually be equal to or slightly less than the material thickness of the cup 21.

As the draw proceeds and the blank-holder 27 passes along the cylindrical outer face of the punch 26, pushing the piston 29 before it, the air in the chamber 47 is forced into the receiver 42 through an exit port 40B and non return valve 43B, shown in FIG. 3. At the end of the forward stroke of ram 10, the piston 29 is at the bottom of its travel in the tool holder 19 (see FIG. 7). As the ram is retracting on its return stroke away from the punch 26, air enters the air cylinder through port 40A and non return valve 43A raising the piston 29 to return the blank-holder 27 to the starting position shown in FIG. 3. This displacement and re-circulation of air provides a further means for thermal control of the tool temperature, in addition to the thermal control conduits 32 and 33.

At the end of the forward or redraw stroke, the air vent 36 shown in FIG. 3 in the punch 26 permits release of the redrawn can while the die is retracting. The ejector 37 in top tool 20 is shown with a profiled end face 37A (FIG. 3) to coact with the end face of the punch 26 to form to an appropriate profile of the bottom of the can 39. As the ram retracts, the ejector 37 meets a fixed can ejector stop 38 (FIG. 3) within the tool unit 20, so that the can 39 is pushed out as the die 25 retracts beyond the ejector 37.

Figure 9:
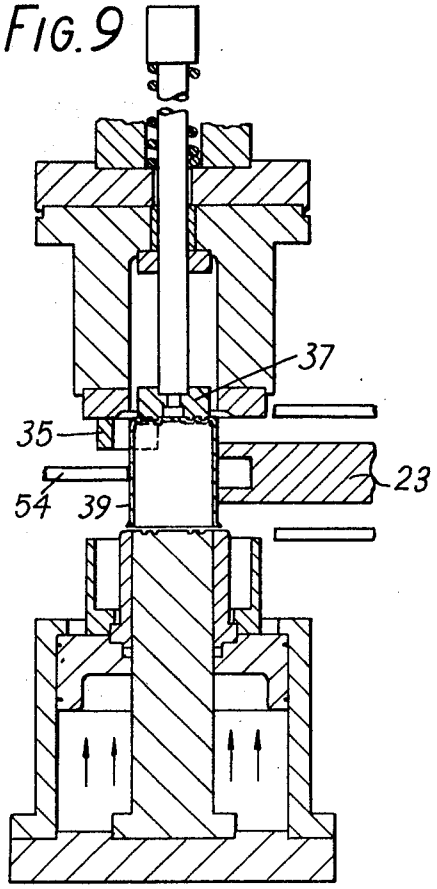
FIGS. 8 and 9 show how the redrawn cup is ejected from the tools.
Figure 8:
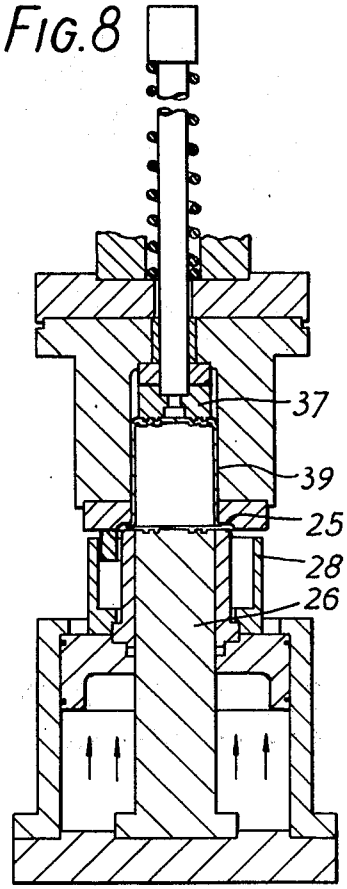

In FIG. 9 the can 39 is shown ejected by ejector 37 and about to be guided out of the tools by the inner guide 54 and the exit star wheel 23.

Figure 10:
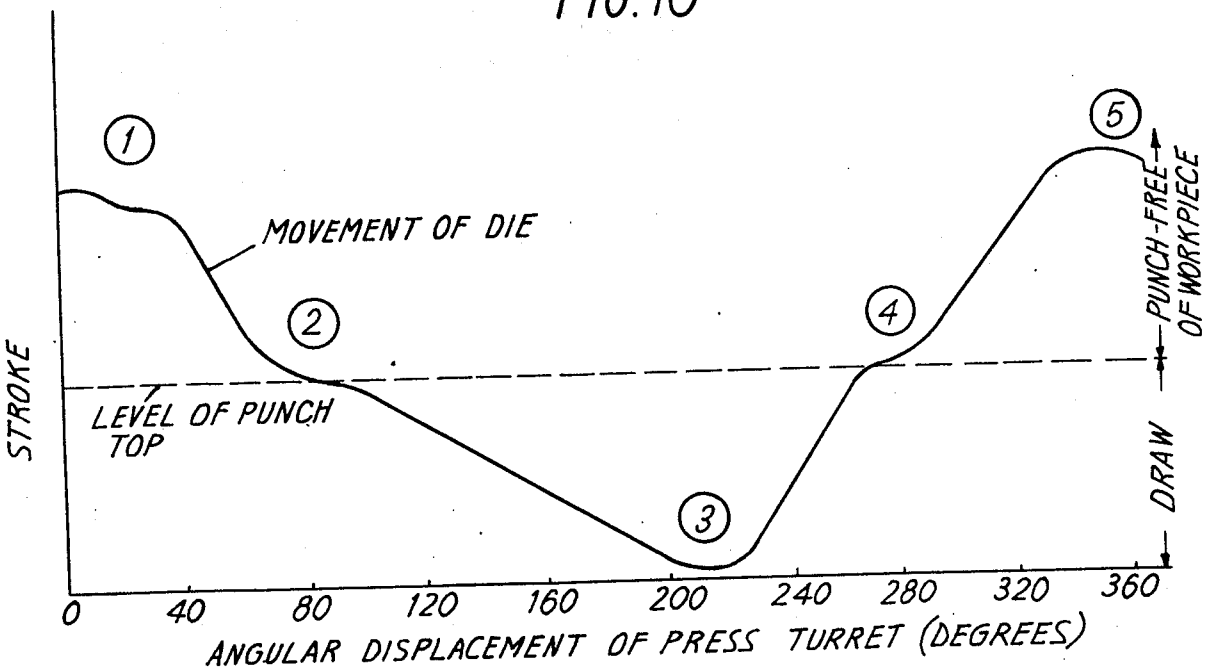
FIG. 10 is a displacement diagram to illustrate the principle of the method according to the invention.

Referring now to FIG. 10, the longitudinal position of the ram 10, and therefore the die, in the forward and return strokes is plotted therein in linear units vertically against the angular displacement of the turret 8 and tool bolster 9 from a starting point in degrees of rotation through the press cycle. The diagram starts with the ram nearly at the top of the stroke and descending until, at the point (1), the speed of descent is slowed to allow the punch to pick up the workpiece 21 gently after which the rate of descent is rapid until the point (2) is reached, where the ram velocity is reduced to zero or nearly zero. The effect of this is that the workpiece 21 is brought into clamped engagement between the die 25 and the blank holder 27 while the ram velocity is very low, thus minimising the effects of impact. Thus gentle clamping reduces the noise made by the press tools. After this the ram carries out the working stroke at a substantially constant velocity until the end of the stroke indicated at (3); whereupon reversal of the stroke takes place. During the working stroke the cup 21 is redrawn by the die 25 and punch 26 into the form having increased length and reduced diameter, as indicated at 39 in FIG. 3.

The return stroke is preferably faster than the working stroke. However, when can stripping is to be carried out, the ram velocity is reduced to zero or nearly to zero when the ram reaches the position shown at (4) corresponding to the position (2) on the forward stroke, position (4) being that at which the ejector 37 gently meets the can 39 to start to eject the can before the ram is finally retracted to the top position (5) in the stroke. Again the gentle engagement of the ejector with the can permits quieter working. There may be advantages in having some period of dwell at the top position (5) of the stroke to allow clearance of the redrawn can and placement of another can for redrawing in the apparatus. The method is applicable to cases when the ram carries a punch or a die to coact with the necessary complementary tooling on the tool rest.

In the preferred method, not only is the ram velocity controlled, but the blank holding pressure of the blank holder 27 is preferably also controlled, as described above, during the draw, being restricted to maintain at least a minimum gap during the forward or draw stroke by means of a limiting means such as the stop 28 and limit ring 31.

Although the press has been described herein in terms of a redrawing operation, the invention is not limited thereto because the control of the relative approach speeds of the tool components is of generaly application to all drawing operations for cup-shaped workpieces or components.

Furthermore, in high speed can-making operations in general the provision of thermal control, providing warming of the tools before production and cooling during production, as is the case in the arrangement described herein, is advantageous.

What we claim is:

1. A single action cam operated press comprising two end frames in spaced relationship to each other, an axle spanning the distance between said end frames, means for rotating said axle, said axle having fixed thereto a tool bolster and a turret in axial spaced relationship to each other, said tool bolster carrying a plurality of first tools, a plurality of rams disposed for reciprocal motion parallel to said axle, a plurality of guide ways defined by said turret for guiding the reciprocal motion of said rams, a drum cam means fixed to a first of said end frames remote from said tool bolster, each ram having at an end thereof adjacent said first end frame a follower in contact with said drum cam means, each ram having at an end thereof adjacent said tool bolster a second tool with pairs of said first and second tools being in axial alignment, preloaded tie bars extending between said end frames to maintain said end frames in spaced relationship and said drum cam means in spaced axial relationship to said tool bolster and said turret, said drum cam means being operative during rotation of said tool bolster, turret and rams to move said rams in a sequence of motion including a. impact free engagement of a workpiece between said first and second tools followed by
b. a workpiece forming operation beginning at zero velocity of said rams at controlled acceleration and terminates with controlled deceleration followed by
c. a return stroke of said rams of greater linear velocity than the forming operation, and
d. said return stroke includes at least one period of deceleration during which the formed article is stripped from the punch.

2. The press as defined in claim 1 wherein said drum cam means is a desmodronic cam.

3. The press as defined in claim 1 wherein said first tools are punches and said second tools are dies.

4. The press as defined in claim 1 wherein said first tools are each defined by a punch disposed within a cylinder and having an end portion projecting outwardly therefrom, a workpiece holder surrounding said punch end portion, a piston mounted for reciprocal movement in said cylinder, said workpiece holder being secured to said piston, and fluid pressure means for pressurizing the interior of said cylinder for normally biasing said piston and the workpiece holder carried thereby in a direction toward said second tools.

5. The press as defined in claim 4 including means for recycling the fluid through said second tools.

6. The press as defined in claim 4 wherein said second tools are dies, a stop fixed to and carried by said piston, and means carried by said die for abutment against said stop to maintain a minimum gap between each punch and die when the latter are most proximate each other.

7. The press as defined in claim 6 wherein said workpiece holder is in concentric external relationship to said punch.

8. The press as defined in claim 6 wherein said stop is in concentric external relationship to both said punch and workpiece holder.

9. A single action cam operated press comprising two end frames in spaced relationship to each other, an axle spanning the distance between said end frames, means for rotating said axle, said axle having fixed thereto a tool bolster and a turret in axial spaced relationship to each other, said tool bolster carrying a plurality of first tools, a plurality of rams disposed for reciprocal motion parallel to said axle, a plurality of guide ways defined by said turret for guiding the reciprocal motion of said rams, drum cam means fixed to a first of said end frames remote from said tool bolster, each ram having at an end thereof adjacent said first end frame a follower in contact with said drum cam means, each ram having at an end thereof adjacent said tool bolster a second tool with pairs of said first and second tools being in axial alignment, said drum cam means being in spaced axial relationship to said tool bolster and said turret, said drum cam means being operative during rotation of said tool bolster, turret and rams to move said rams in a sequence of motion including a. impact free engagement of a workpiece between said first and second tools followed by
b. a workpiece forming operation beginning at zero velocity of said rams at controlled acceleration and terminates with controlled deceleration followed by
c. a return stroke of said rams of greater linear velocity than the forming operation, and
d. said return stroke includes at least one period of deceleration during which the formed article is stripped from the punch.

10. The press as defined in claim 9 wherein said drum cam means is a desmodronic cam.

11. The press as defined in claim 9 wherein said first tools are punches and said second tools are dies.

12. A tool unit comprising a pair of axially aligned relatively reciprocal tools, a first of said tools including a punch housed within a cylinder and having an end portion projecting outwardly therefrom, a piston in external surrounding relationship to said punch, means for delivering fluid under pressure into said cylinder for normally biasing said piston in a direction toward a second of said tools, a workpiece holder surrounding said punch end portion and being fixed to said piston, said second tool being a die, and cooperative means between said first and second tools for maintaining a predetermined gap between said punch and die when the latter are most closely adjacent each other by overriding the biasing force of the pressurized fluid in said cylinder and moving said piston in a direction away from said die.

13. The tool unit as defined in claim 12 wherein said cooperative means are abutment means carried by said first and second tools for axial abutting contact with each other.

14. The tool unit as defined in claim 13 wherein said abutment means of said first tool is a sleeve in external concentric relationship to said punch and is fixed to said piston.

15. The tool unit as defined in claim 13 wherein said abutment means of said first tool is fixed to said piston.

16. The tool unit as defined in claim 14 wherein said abutment sleeve is also in external concentric relationship to said workpiece holder.

17. The tool unit as defined in claim 15 wherein said abutment means of said second tool is a stop which projects axially beyond said die.

18. The tool unit as defined in claim 15 wherein said abutment means of said second tool is a stop ring in external concentric relationship to said die and projects axially therebeyond.

* * * * *